United States Patent [19]

Borries

[11] 4,004,859

[45] Jan. 25, 1977

[54] AIR TOOL WITH SPEED RESPONSIVE SHUTOFF

[75] Inventor: John A. Borries, Chesterland, Ohio

[73] Assignee: Cooper Industries, Inc., Houston, Tex.

[22] Filed: Aug. 18, 1975

[21] Appl. No.: 605,224

[52] U.S. Cl. ..... 415/25; 173/12

[51] Int. Cl.[2] ..... F01D 25/00

[58] Field of Search ..... 415/25, 36; 418/40–43; 137/56, 58; 173/12

[56] References Cited

UNITED STATES PATENTS

| | | | |
|---|---|---|---|
| 3,373,824 | 11/1967 | Whitehouse | 173/12 |
| 3,608,647 | 9/1971 | Bories | 173/12 |
| 3,740,174 | 6/1973 | Amtsberg | 418/43 |
| 3,785,442 | 1/1974 | Amtsberg | 173/12 |
| 3,791,458 | 2/1974 | Wallace | 418/43 |
| 3,904,305 | 9/1975 | Boyd | 415/25 |
| 3,930,764 | 1/1976 | Curtiss | 137/57 |

*Primary Examiner*—Henry F. Raduazo
*Attorney, Agent, or Firm*—Vincent L. Barker, Jr.

[57] ABSTRACT

A speed responsive shutoff for a pneumatic tool such as a nut runner is disclosed. The shutoff, effective to terminate air supply to the air motor under load, employs a centrifugally operated air valve having a flat valve head which is biased against a valve seat through which pressurized air travels en route to the motor. A small orifice in the valve head leads to an expansible chamber behind the head. In operation of the tool, when the throttle valve is open, initial air is supplied to the motor by a slight opening of the air valve due to a higher pressure in front of the valve head than behind it. The motor quickly reaches a predetermined speed level at which time the air valve is fully opened by centrifugal weights. Under loading approaching stall, the motor slows to a speed low enough to allow the air valve to move toward closure under the influence of a spring. Pressure builds up in front of the valve head but has sufficient time to pass through the orifice and pressurize the chamber behind the valve head, equalizing the two pressures and allowing the spring to fully close the air valve. Because the shutoff occurs before the stall condition is attained, stall jerking is substantially eliminated.

6 Claims, 3 Drawing Figures

AIR TOOL WITH SPEED RESPONSIVE SHUTOFF

BACKGROUND OF THE INVENTION

The invention relates to pneumatic rotary tools, and more particularly to a pre-stall air shutoff for such tools which is dependent upon a speed responsive device to sense the approaching stall and shut off the tool.

Most prior art rotary tools using a vane-type air motor have used a pressure sensing valve to automatically shut off the tool as the torque resistance encountered causes a build up of back pressure from the air motor to a predetermined value. Examples of such tools are disclosed in U.S. Pat. Nos. 3,373,824 and 3,608,647. This pressure sensitive system, while satisfactory in many applications, has disadvantages in that it is sensitive to line pressure variations. A pressure surge in the line, for example, can prematurely stop the tool. Similarly, sudden opening of the throttle valve can sometimes cause a surge sufficient to activate the shutoff. The most serious effect of pressure sensitivity in such tools, however, occurs when line pressure is too low to activate the shutoff. This condition can occur when there is overdraw on the air line, for example. With a high-torque tool, failure of the shutoff to activate can result in an unexpected and dangerous stall jerk or kick on the operator. Another problem with pressure responsive shutoffs is their sensitivity to air line lubrication and to contaminants carried by the supply air. Hose residue, for example, can interfere with the valving of such tools to the extent that torque output is affected.

Other prior art tools have used mechanical means such as clutches or ratchet-type devices to control the effective output torque upon a fastener or joint; these devices are usually complex and subject to wear and thus continuous maintenance costs. They also will produce a stall jerk if a pressure drop of sufficient magnitude to reduce motor torque below the clutch setting is encountered.

A tool of the type to which this invention relates is shown in Wallace U.S. Pat. No. 3,791,458. Designed to relieve the stall loading jerk on an operator during tightening of a fastener, the tool employs a speed sensitive air shutoff which terminates air supply to the air motor at a speed just above stall. The tool disclosed in that patent utilizes a slidable spool-type valve which is spring-biased toward its open position. A pressure chamber at the lower end of the slidable valve member receives pressurized air as long as the tool's throttle valve is open. However, once the air motor of the tool has built up a degree of speed, an exhaust outlet from the pressure chamber prevents the chamber from fully pressurizing to move the valve to the closed position. A rotatable, centrifugally responsive ball and seat valve is employed to keep the exhaust outlet open during normal operation of the tool but to close it during the low speed associated with a stall, allowing the chamber to fully pressurize and close off the air supply to the motor. The primary disadvantages of this tool are construction and maintenance cost. The tool involves rather complex structure including a rotational air coupling which is subject to a great deal of wear, resulting in erratic tool operation.

Another pneumatic tool employing speed responsive shutoff which functions in a manner somewhat similar to that of the present invention is shown in U.S. Pat. application Ser. No. 498,619, filed Aug. 19, 1974, now U.S. Pat. No. 3,904,305, assigned to the same assignee as the present application. In the shutoff apparatus shown in that application, a starting bypass porting and valve arrangement is employed which is relatively expensive to produce and which adds weight and length to the tool. By its relative complexity in comparison to the present invention, it may also require more maintenance.

SUMMARY OF THE INVENTION

The present invention provides a speed responsive air tool shutoff which, like the tool of the aforementioned application Ser. No. 498,619, utilizes a centrifugally operated air valve somewhat similar to a conventional governor to control the point of shutoff of the tool. Unlike the shutoff apparatus of the above disclosure, however, the air valve of the present shutoff includes a flat valve head positioned to engage an annular valve seat through which the pressurized air supply to the motor passes. Extending through the valve head is a small orifice which communicates with an expansible chamber behind the valve head. An additional expansible chamber is provided in the shutoff valve apparatus such that when the valve moves to a certain extent toward closure, there is provided behind the valve head additional area on which pressurized air can act to quickly snap the shutoff valve closed.

In the closed position of the shutoff valve, when the throttle valve of the tool is initially opened, there is an instant of pressure imbalance on the valve head before the restrictive orifice has time to allow the chamber behind the valve head to pressurize. Therefore, for a short time pressure is greater on the front of the valve head and is sufficient to overcome a spring which biases the valve toward the closed position, thereby letting sufficient air through the valve to quickly run the motor up to near operating speed. This usually occurs during the initial moment of rundown of a fastener.

When the tool's motor has built up to near operating speed, centrifugal weights associated with the air valve swing out to fully open the valve and allow a normal operating volume of air to reach the motor. At this point, pressure is approximately equalized on either side of the valve head.

As the joint begins to tighten and the tool encounters increased resistance, the speed of the air motor begins to decrease. At a pedetermined low motor speed representative of the desired applied torque, the centrifugal weights holding the valve open are overcome by the compression spring on the valve, and the valve begins to move toward closure. Air pressure of course builds up in front of the valve head due to its restricted position, but also passes through the orifice the pressurize the chamber behind the valve head as well. Thus, pressure is equalized and the spring is able to continue moving the valve toward the closed position. The closure of the valve is accelerated when it reaches a certain point at which pressurized air from in front of the valve head and from the chamber behind the valve head is admitted to a second expansible chamber behind the valve head which acts to increase the area behind the valve head so that the spring is assisted by an additional force imbalance. Consequently, the air valve quickly snaps closed, shutting off all air to the motor and stopping the tool shortly therafter so that an accurate torque has been applied to the joint.

As long as the throttle valve is held open after the tool has shut off, the shutoff valve remains closed due to the equalized pressures on either side of the valve head, the larger area behind the valve head, and the bias pressure of the compression spring. Upon closure of the throttle valve, the pressurized condition on both sides of the valve head is dissipated to the atmosphere through a slot on the shaft of the throttle valve, and the shutoff valve remains closed until the tool is again started by opening of the throttle valve.

The speed responsive air shutoff of the present invention does not rely upon the sensing of air back pressure build up for its operation and thus overcomes the disadvantages of the above discussed pressure sensing tools. Another advantage of the speed sensing feature is the ability to regulate output torque of the tool simply by varying line pressure. In addition, the shutoff apparatus of the invention is an improvement over the speed sensing shutoff of the above discussed patent application in that it is much simpler in construction and operation, eliminating additional weight, length and maintenance requirements of the tool.

DESCRIPTION OF THE PREFERRED EMBODIMENT

Figure 1:
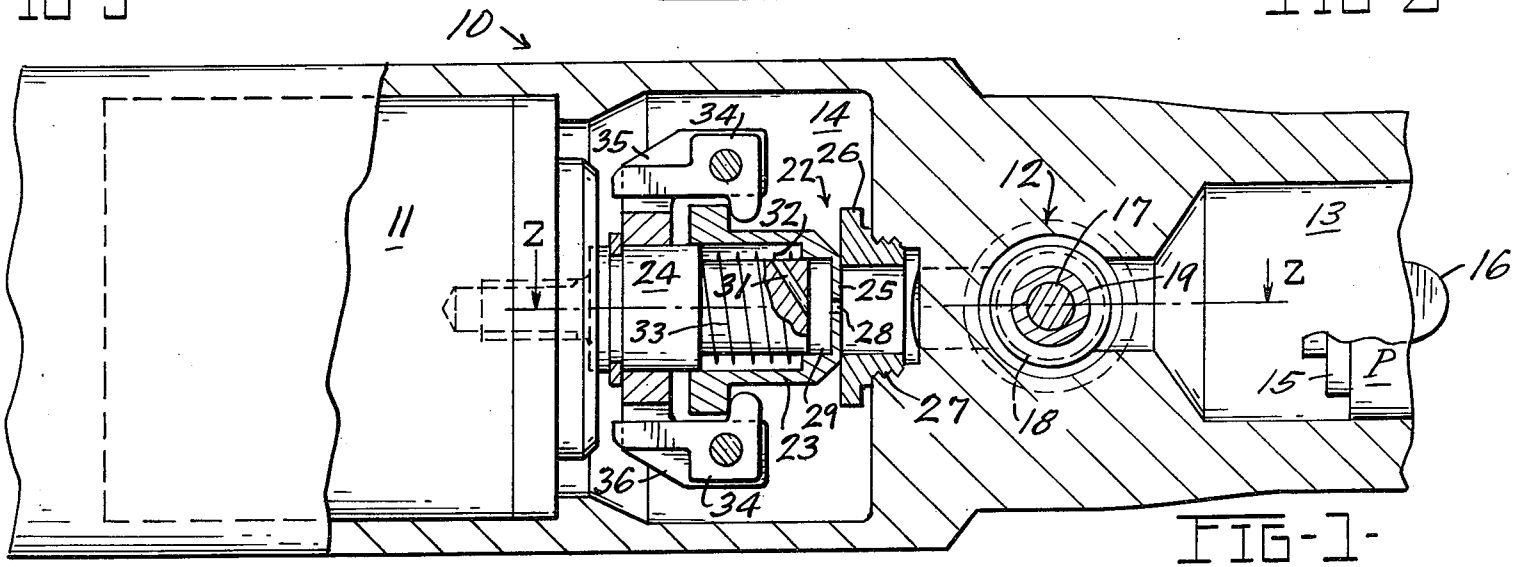
FIG. 1 is a sectional view of a portion of a rotary air tool including an air shutoff according to the present invention.

FIG. 1 of the drawings shows in section a portion of an air tool 10 such as an angle nut runner. The tool 10 includes an air motor 11, a throttle valve 12 behind which is a chamber 13 communicating through a pressure regulator 15 with a source of pressurized air (not shown), and a speed responsive air shutoff 14 between the throttle valve 12 and the motor 11. The shutoff 14 is adapted to terminate the flow of pressurized air from the throttle valve 12 to the air motor 11 when the motor 11 slows to a given speed approaching stall while torquing a fastener, and to keep the air supply shut off until the throttle valve 12 is again closed.

Figure 2:
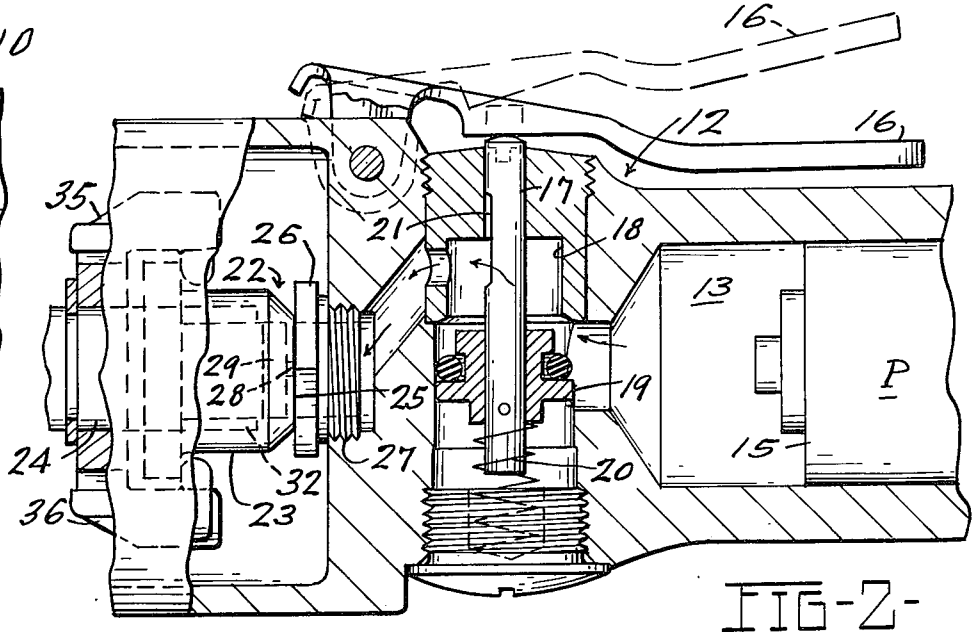
FIG. 2 is a sectional view taken along the line 2—2 of FIG. 1.

As FIG. 2 indicates, the throttle valve 12 includes a depressing lever 16 on the exterior of the tool, a valve stem 17, a seat 18, a closed member 19, and a compression spring 20 biasing the valve 12 toward its closed position. On the valve stem is a flat 21, the function of which will be explained below. The structure of the throttle valve 12 is typical of many air tools and is not considered to be a part of this invention.

Figure 3:
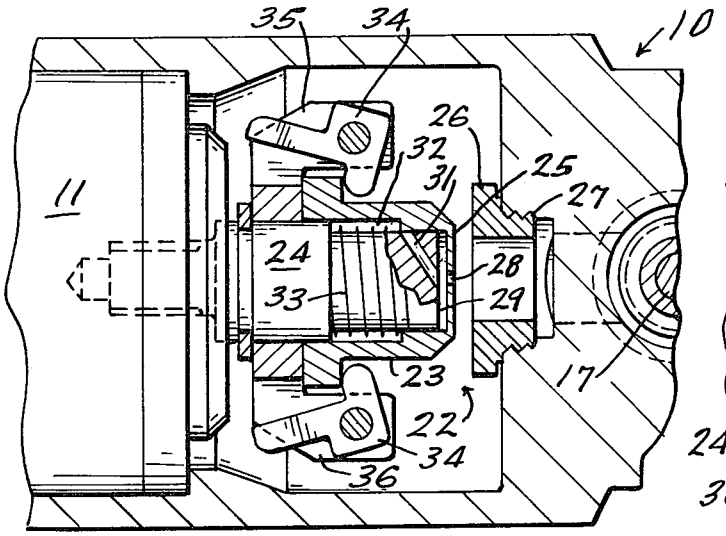
FIG. 3 is a view similar to a portion of FIG. 1 but with the shutoff valve of the tool shown in the open position.

Downstream of the throttle valve 12, as FIGS. 1 through 3 indicate, the shutoff means 14 includes a shutoff valve 22 which is open during torquing of the work and during most of the rundown of the work. The valve 22 includes a valve closing sleeve 23 which is slidable upon a rotor shaft extension 24 driven by the motor 11. The sleeve 23 is not keyed into the shaft extension 24 for rotation therewith; it may rotate with or rotationally slip upon the shaft extension 24. At the upstream end of the valve closing sleeve 23 is a valve head or cap 25 positioned to come into contact with a flange 26 of a stationary sleeve 27 affixed to the body of the tool 10. In this position of the slidable valve sleeve 23, the space between the upstream end of the rotor shaft extension 24 and the stationary flange 26 is closed, thereby preventing the passage of air therethrough.

As shown in FIGS. 1 and 3, the valve head 25 includes a small orifice 28 leading to an expansible chamber 29 behind the valve head. The term "behind" as used herein and in the claims refers to a position on the opposite side of the valve head from the upstream side. The chamber 29 is defined by the upstream end of the rotor shaft extension 24, the interior of the sleeve 23, and the back side of the valve head 25. The area of the back side of the valve head 25 is approximately equal to the exposed area of its front side when it is in the closed position against the flange 26, as shown in FIG. 1. These areas are surfaces on which air pressure acts to affect opening and closing of the valve, as will be discussed below. In addition, an oblique bore 31 is provided through the upstream end of the rotor shaft extension 24 for accelerating the closure of the valve sleeve 23 once it has progressed beyond a certain point. That point is defined by the uncovering of the downstream end of the bore 31 by the valve closing sleeve 23. This enables pressurized air from the throttle valve 12 to enter an expansible chamber 32 defined between the rotor shaft extension 24 and the surrounding valve closing sleeve 23. A compression spring 33 biases the valve sleeve 23 and head 25 toward the closed position.

The valve 22 is opened by centrifugal weights 34 pivotally connected to a rotating yoke 36. As shown in FIGS. 1 and 3, the weights 34 are adapted to urge the valve sleeve 23 against the spring bias to open the valve 22 upon the attainment of a predetermined motor speed level. Six such weights (four not shown) may be provided, equally spaced around the yoke 36. It should be noted here that, contrary to the usual arrangement of a centrifugal weight governor, the valve 22 is opened by increased speed and closed by decreased speed.

The closed position of the shutoff valve is shown in FIG. 1. Prior to the opening of the shutoff valve by the centrifugal weights 34, an initial air supply is supplied to the motor by a slight opening of the valve 22 against the force of the compression spring 33. This opening occurs when the throttle valve is first opened. Air pressure quickly builds against the front of the valve head 25 and causes the head 25 and valve sleeve 23 to recede slightly, allowing air at a low flow rate to pass through the valve 22 and reach the air motor 11. This occurs because the small orifice 28 in the valve head 25 does not permit sufficient air pressure to enter the expansible chamber 29 and, via the oblique bore 31, the expansible chamber 32. The differential pressure on the two sides of the valve head 25 is therefore sufficient to momentarily open the valve 22 somewhat. By the time sufficient pressure would have built up inside the expansible chambers 29 and 32, the air motor 11 has built up sufficient speed to swing the centrifugal weights 34 partially outwardly to further open the shutoff valve 22.

The complete cycle of operation of the speed responsive shutoff 14 of the rotary air tool 10 is quite simple. With the line air pressure or the flow regulator 15 adjusted to a setting corresponding to the desired output torque, pressurized air is admitted into the tool through the throttle valve 12 by the operator's depression of the lever 16. Pressure immediately builds up in the interior of the sleeve 27 against the front of the valve head 25. This air pressure quickly opens the valve 22 slightly, overcoming the force of the compression spring 33 as discussed above. Air is thus supplied to the motor 11 in limited quantity in this initial startup period. The initial air is sufficient to start the motor and quickly bring it to about 5000 r.p.m. or more. At this time, the output spindle (not shown) of the tool 10 is engaged in the running down of a fastener. During this brief phase, the output spindle torque of the tool, though lower than that of the next phase, is sufficient to run down even a "prevailing torque" fastener. In this position of the valve 22, not shown in the drawings, the valve head 25 and valve sleeve 23 are only slightly to the left of the position shown in FIG. 1.

The motor 11 quickly reaches the predetermined speed, which may be in the range of about 1500–20000 r.p.m., before the expansible chambers 29 and 32 have built up sufficient pressure to move the valve sleeve 23 and head 25 to the closed position with the help of the compression spring 33. At this point, the pivoted weights 34 on the rotating yoke 36 swing out, urging the valve sleeve 23 in a downstream direction against the compression spring 28 as shown in FIG. 3 and fully opening the shutoff valve 22. The weights 34 preferably swing through an angle of about 36°, overcoming the force of the spring 33 and any air pressure in the chambers 29 and 32, as well as friction.

The normal operating phase of the air tool 10 is shown in FIG. 3. The shutoff valve 22 remains fully open, with the valve sleeve 23 in a position blocking off the downstream end of the oblique bore 31. Air pressure on either side of the valve head 25 is substantially equal.

With the shutoff valve 22 remaining fully open as shown in FIG. 3, the tool 10 completes the rundown and begins the torquing of the fastener. The valve remains substantially fully open until the motor 11, during torquing of the fastener, is slowed to near stall, i.e., in the range of 100–1000 r.p.m. At this speed, representative of the desired final torque on the fastener, the valve sleeve begins to slide toward the closed position, the force of the return spring 33 being greater than the centrifugal effect of the weights 34.

As the valve head 25 moves toward closure, air pressure upstream of the valve head increases. This higher air pressure has ample time during the movement of the sleeve 23 and valve head 25 to pressurize the chamber 29 behind the valve head by movement of air through the orifice 28. Thus, pressure on either side of the valve head 25 is almost balanced during the closing movement of the valve sleeve and head. The effect of upstream air pressure is at least partially offset by pressurization of the chamber 29, and the spring 33 continues to move the assembly toward closure. When the closure of the sleeve 23 has proceeded to such a point that the downstream end of the oblique air passage bore 31 is uncovered, the expansible chamber 32 adjacent the spring 33 is quickly pressurized by high pressure air from the chamber 29. This increases the area subject to pressurized air behind the valve head 25, so that air pressure, in combination with the spring force, closes the valve with a snap action. The air supply is totally shut off and the motor 11 stops.

Although the operator of the tool 10 may hold the throttle valve 12 open for a time after shutoff of the tool, air flow to the motor 11 will not be resumed. As seen in FIG. 1, pressurized air from the throttle 12 continues to be available for pressing against the upstream side of the valve head 25, but an equal pressure continues to be maintained in the expansible chambers 29 and 32, and the compression spring 33 continues to act, so that the net force acting on the sleeve 23 and head 25 assembly is toward the closed position.

When the throttle valve 12 is ultimately closed by the operator, air pressure on both sides of the valve head 25 and in the chamber 32 is dissipated through the bore 31, the orifice 28 and the flat 21 on the throttle valve stem 17. The shutoff valve 22 is thus prepared for the next usage of the tool 10.

I claim:

1. A speed responsive shutoff for a rotary air tool driven by an air motor operable by a throttle valve with an air passage therebetween, comprising:

an air shutoff valve in the air passage between the air motor and the throttle valve including means biasing the valve toward its closed position to close off the air passage;

said shutoff valve including a valve seat positioned in the air passage, a valve head movable toward and away from the valve seat, means defining an expansible chamber behind the valve head for urging the valve head toward the closed position when the chamber is pressurized, an orifice through the valve head establishing communication between the expansible chamber and the upstream side of the valve head, said orifice being sufficiently small to enable upstream air pressure on initial opening of the throttle valve to open the valve against the biasing means sufficiently to run the air motor up to said predetermined speed level;

means for opening the shutoff valve response to the attainment of a predetermined motor speed level; and means for dissipating air pressure from the expansible chamber when the throttle valve is closed;

whereby, when the air motor slows to a second speed level under load, the biasing means overcomes the opening means and moves the valve head toward the closed position, and as air pressure builds upstream of the valve head, the expansible chamber becomes pressurized to at least partially offset the effect of upstream air pressure, allowing the valve to be closed under the influence of the biasing means.

2. The speed responsive shutoff of claim 1 which further includes means for accerlerating the movement of the valve head toward the closed position after it has proceeded beyond a predetermined point.

3. The speed responsive shutoff of claim 2 which further includes a sleeve connected to the valve head extending away from the valve seat and a rotating shaft driven by the motor, said sleeve being mounted circumjacent the shaft and axially slidable thereon, said sleeve and shaft defining a second expansible chamber operable on expansion to urge the valve head toward closure and passageway means placing the second expansible chamber in communication with pressurized air after the sleeve and valve head have moved toward closure beyond said predetermined point.

4. The speed responsive shutoff of claim 3 wherein said passageway means communicates directly with the first mentioned expansible chamber.

5. A speed responsive shutoff control for a rotary fluid motor comprising, in combination, a fluid passage connecting a source of fluid under pressure with the motor, a throttle valve in the fluid passage, a shutoff valve in passage between the throttle valve and the motor, first means biasing the shutoff valve toward a closed position, said shutoff valve including second means for partially opening the shutoff valve on initial opening of the throttle valve to an extent and for a length of time sufficient to run the motor up to a predetermined minimum speed, a centrifugally operated device driven by the motor and operably positioned to fully open the shutoff valve as motor speed reaches said predetermined speed, and third means operable after the motor has reached said predetermined minimum speed for counteracting the force of said second means, whereby, after the motor has reached said predetermined speed to cause the centrifugally operated device to open the shutoff valve, a subsequent drop in motor speed to a low speed below said predetermined minimum speed will cause the shutoff valve to close under the influence of said biasing means, thereby shutting off the fluid supply to the motor.

6. A speed responsive shutoff for a rotary tool driven by a fluid motor and including a throttle valve controlling the supply of fluid through a fluid passage leading to the motor, comprising a shutoff valve biased toward a closed position, first means exposed to fluid pressure and effective to open the valve against the bias, second means responsive to motor speed effective to hold the valve open above a predetermined speed, and third means exposed to fluid pressure and effective to counteract said first means after a predetermined time period, whereby, after said predetermined time said third means has counteracted said first means and a drop in motor speed below the second predetermined speed has deactivated said second means, said valve will be biased to its closed position.

* * * * *

UNITED STATES PATENT OFFICE

CERTIFICATE OF CORRECTION

Patent No. 4,004,859 Dated January 25, 1977

Inventor(s) John A. Borries

It is certified that error appears in the above-identified patent and that said Letters Patent are hereby corrected as shown below:

In the specification:

Column 3, line 46 - "closed" should be -- closing --.

Column 5, line 11 - "20000" should be -- 2000 --.

In the claims:

Column 6, line 28 - after "valve", insert -- in --.

Signed and Sealed this

Fifth Day of April 1977

[SEAL]

*Attest:*

RUTH C. MASON
*Attesting Officer*

C. MARSHALL DANN
*Commissioner of Patents and Trademarks*